US012753589B2

(12) United States Patent
Cheng et al.

(10) Patent No.: US 12,753,589 B2
(45) Date of Patent: Oct. 6, 2026

(54) WATER NOZZLE INSTALLATION STRUCTURE

(71) Applicant: Beijing Kohler Ltd., Beijing (CN)

(72) Inventors: Guang Cheng, Beijing (CN); Huan Li, Beijing (CN)

(73) Assignee: Beijing Kohler Ltd., Beijing (CN)

( * ) Notice: Subject to any disclaimer, the term of this patent is extended or adjusted under 35 U.S.C. 154(b) by 99 days.

(21) Appl. No.: 18/945,211

(22) Filed: Nov. 12, 2024

(65) Prior Publication Data

US 2025/0154749 A1 May 15, 2025

(30) Foreign Application Priority Data

Nov. 14, 2023 (CN) ..... 202323078264.2

(51) Int. Cl.
*E03C 1/04* (2006.01)

(52) U.S. Cl.
CPC ..... *E03C 1/0401* (2013.01); *E03C 1/0403* (2013.01)

(58) Field of Classification Search
CPC .... E03C 1/0401; E03C 1/0402; E03C 1/0403; E03C 1/0404
See application file for complete search history.

(56) References Cited

U.S. PATENT DOCUMENTS

| | | | | |
|---|---|---|---|---|
| 7,832,428 | B2 | 11/2010 | Leutwyler | |
| 8,863,769 | B2 | 10/2014 | Andersen et al. | |
| 9,145,665 | B2 | 9/2015 | Bors et al. | |
| 10,344,459 | B2 | 7/2019 | Lu et al. | |
| 10,563,383 | B2 | 2/2020 | Lu et al. | |
| 11,598,438 | B1 * | 3/2023 | You | E03C 1/0403 |
| 2010/0206409 | A1 | 8/2010 | Gautschi et al. | |
| 2011/0233921 | A1 | 9/2011 | Peteri | |
| 2013/0333109 | A1 * | 12/2013 | Li | E03C 1/0402 4/695 |
| 2014/0230935 | A1 | 8/2014 | Tan et al. | |
| 2017/0009433 | A1 | 1/2017 | Song et al. | |
| 2022/0154434 | A1 | 5/2022 | Reich | |
| 2023/0075627 | A1 | 3/2023 | Wang et al. | |

FOREIGN PATENT DOCUMENTS

| | | | |
|---|---|---|---|
| CN | 203924271 | U | 11/2014 |
| CN | 105484327 | A | 4/2016 |
| CN | 105569128 | A | 5/2016 |
| CN | 108413092 | A | 8/2018 |

(Continued)

*Primary Examiner* — Tuan N Nguyen
(74) *Attorney, Agent, or Firm* — Foley & Lardner LLP

(57) ABSTRACT

The present disclosure is generally towards a water nozzle installation structure. The water nozzle installation structure includes a water nozzle, a water inlet pipe, and a connection mechanism. The connection mechanism includes a fastening element having a clamp, a slide plate, and a resilient element for driving the slide plate to reset. An outlet end of the water inlet pipe extends into the fastening element, and the clamp may be fastened to the outlet end. The water inlet pipe is secured with the fastening element through the clamp and a pressing member on a water nozzle base may drive the slide plate to tightly press against and lock a cavity wall protrusion inside the water nozzle base. This structure can be applied to a smooth inlet end or to a rough inlet end, allowing for a high degree of practicality.

15 Claims, 11 Drawing Sheets

(56) References Cited

FOREIGN PATENT DOCUMENTS

| | | | |
|---|---|---|---|
| CN | 109680765 | A | 4/2019 |
| CN | 111779081 | A | 10/2020 |
| CN | 212028679 | U | 11/2020 |
| CN | 113235699 | A | 8/2021 |
| CN | 214037289 | U | 8/2021 |
| CN | 214037290 | U | 8/2021 |
| CN | 215763619 | U | 2/2022 |
| CN | 217651917 | U | 10/2022 |
| EP | 3 222 787 | A1 | 9/2017 |
| EP | 3 404 149 | B1 | 11/2018 |
| EP | 3 540 130 | B1 | 9/2019 |
| GB | 2 311 577 | A | 10/1997 |
| WO | WO-97/49496 | A1 | 12/1997 |

* cited by examiner

WATER NOZZLE INSTALLATION STRUCTURE

CROSS-REFERENCE TO RELATED APPLICATIONS

This application claims the benefit of and priority to Chinese Patent Application No. CN202323078264, filed on Nov. 14, 2023, the entire disclosure of which is hereby incorporated by reference herein.

BACKGROUND

The present disclosure relates generally to a water nozzle installation structure. A water nozzle is commonly known as a faucet, and the water nozzle has a base that is connected to a water inlet pipe to supply water.

Generally, the water inlet pipe is connected to a docking pipe of the water nozzle in the following two main ways. The first way is to provide threads on an outlet end of the water inlet pipe and the docking pipe respectively, threadedly connecting the outlet end to the docking pipe, and then locking them with a nut. The second way is to provide a screw through hole on a side portion of the docking pipe, provide a flat portion or a recess on a side portion of an outlet end of the water inlet pipe, insert the outlet end into the docking pipe, then screw a screw into the side portion such that the screw passes through the screw through hole to tightly press against the flat portion or connect with the recess to secure the water inlet pipe with the docking pipe.

However, some products will have a water inlet pipe pre-installed on a countertop basin, and the user will see an outlet end of the pre-installed water inlet pipe. For aesthetics, sharing, or other needs, the outlet end of the pre-installed water inlet pipe is made of smooth pipe with smooth surface, no threads, no flat surfaces, or grooves. However, the existing two connection ways cannot be adapted to an outlet end that has a smooth surface, and the existing water nozzle cannot be assembled with an outlet end that has a smooth surface. In view of this, it is necessary to provide a water nozzle installation structure that can be adapted to a smooth outlet end and is easy to disassemble and assemble.

SUMMARY

At least one aspect of the present disclosure relates to a water nozzle installation structure. The water nozzle installation structure includes a water nozzle, a water inlet pipe, and a connection mechanism. The connection mechanism includes a fastening element having a clamp, a slide plate slidingly connected to the fastening element, and a resilient element for driving the slide plate to reset. The water inlet pipe has an outlet end that extends into the fastening element by the clamp. The water inlet pipe is secured with the fastening element through the clamp. A pressing member on a water nozzle base may drive the slide plate to tightly press against and lock it together with a cavity wall protrusion inside the water nozzle base. When disassembly is required, a user can loosen the pressing member, such that the slide plate leaves the cavity wall protrusion under the action of the resilient element, then the water inlet pipe and the connection mechanism can be disassembled from the water nozzle base together, making disassembly and assembly convenient. This structure can be applied to a smooth inlet end or to a rough inlet end, allowing for a high degree of practicality.

The water nozzle includes a water nozzle that has a mounting cavity, a pressing member, and a cavity wall protrusion. The pressing member is removably connected to one side of a cavity wall of the mounting cavity. The cavity wall protrusion protruding inwardly is provided on the other side of the cavity wall of the mounting cavity. The connection mechanism is removably assembled in the mounting cavity. an outlet end of the water inlet pipe is secured in the fastening element by the clamp. When the pressing member is in a pressing state, the slide plate is cooperated with the cavity wall protrusion and is in a locking state, and the connection mechanism is fastened in the mounting cavity.

In various embodiments, the fastening element comprises a sleeve member and a locking member, and the slide plate is slidingly connected with the sleeve member. In various embodiments, an inner surface of a sleeve wall of the sleeve member includes sleeve wall bulge ring for stopping the clamp. The outlet end extends into the sleeve member, the clamp sleeves over the outlet end and is located above the sleeve wall bulge ring, and the locking member is connected to the sleeve member and presses the clamp.

In various embodiments, an outer circumference surface of the clamp has an upper tapered surface and a lower tapered surface. A first radius of the lower tapered surface gradually increases, and a second radius of the upper tapered surface gradually decreases along a direction from bottom to top. The sleeve wall bulge ring has a bulge ring tapered surface adapted to the lower tapered surface and the locking member has a locking member tapered surface adapted to the upper tapered surface. The locking member tapered surface tightly presses against the upper tapered surface and the lower tapered surface tightly presses against the bulge ring tapered surface.

In various embodiments, the locking member is threadedly connected with the sleeve member. The locking member has a locking member through hole or a locking member recess for being cooperated with a wrench tool. In various embodiment, the locking member includes a locking member sleeve body and a locking member top cap that is connected to an upper end of the locking member sleeve body. The locking member sleeve body is connected to the sleeve member and tightly presses against the clamp.

In various embodiments, the cavity wall protrusion has a protrusion ramp that gradually extends obliquely upwardly along the direction from the slide plate to the cavity wall protrusion. The slide plate has a slide plate ramp adapted to the protrusion ramp on one side of the slide plate facing the cavity wall protrusion. The slide plate ramp is tightly pressed against the protrusion ramp when the pressing member is in a pressing state.

In various embodiments, a top surface of the slide plate has an assembly groove, and an assembly groove bottom plate of the assembly groove includes a bottom plate through hole. The water inlet pipe includes a platform and passes through the bottom plate through hole. The slide plate is on the platform. A lower end of the fastening element is in clearance fit in the assembly groove.

In various embodiments, the assembly groove elongated or waist shape and extends along a direction from the pressing member to the cavity wall protrusion. The fastening element is in slidable contact with groove walls on both sides of the assembly groove. In various embodiments, the assembly groove bottom plate includes a bottom plate notch in communication with the bottom plate through hole. The bottom plate notch is located between the bottom plate through hole and the pressing member. A fixed end of the resilient element is assembled in the bottom plate notch and the resilient element abuts against the water inlet pipe.

In various embodiments, an upper surface of the platform is provided with a retaining ring. The retaining ring is located in the bottom plate through hole, and the resilient element abuts against the retaining ring.

At least one aspect of the present disclosure relates to a method for water nozzle installation structure. The method includes fastening a water inlet pipe to a connection mechanism with an outlet end of the water inlet pipe assembled to a fastening element of the connection mechanism, securing the outlet end to the fastening element via a clamp in the connection mechanism, and securing the fastened water inlet pipe and connection mechanism to a water nozzle via a structure in the water nozzle. The water nozzle includes a pressing member. The method includes tightening the pressing member such that a slide plate in the connection mechanism tightly presses against a cavity wall protrusion in the water nozzle. In various embodiments, the structure in the water nozzle is a water nozzle base or a mounting wall cavity. In various embodiments, the clamp secures to the outlet end via clearance fit or direct interference fit.

BRIEF DESCRIPTION OF THE DRAWINGS

With reference to the drawings, the contents disclosed by the application will be more easily understood. It should be understood that: these drawings are merely used for illustration and are not intended to limit the protection scope of the application. In the drawings.

DETAILED DESCRIPTION

Figure 1:
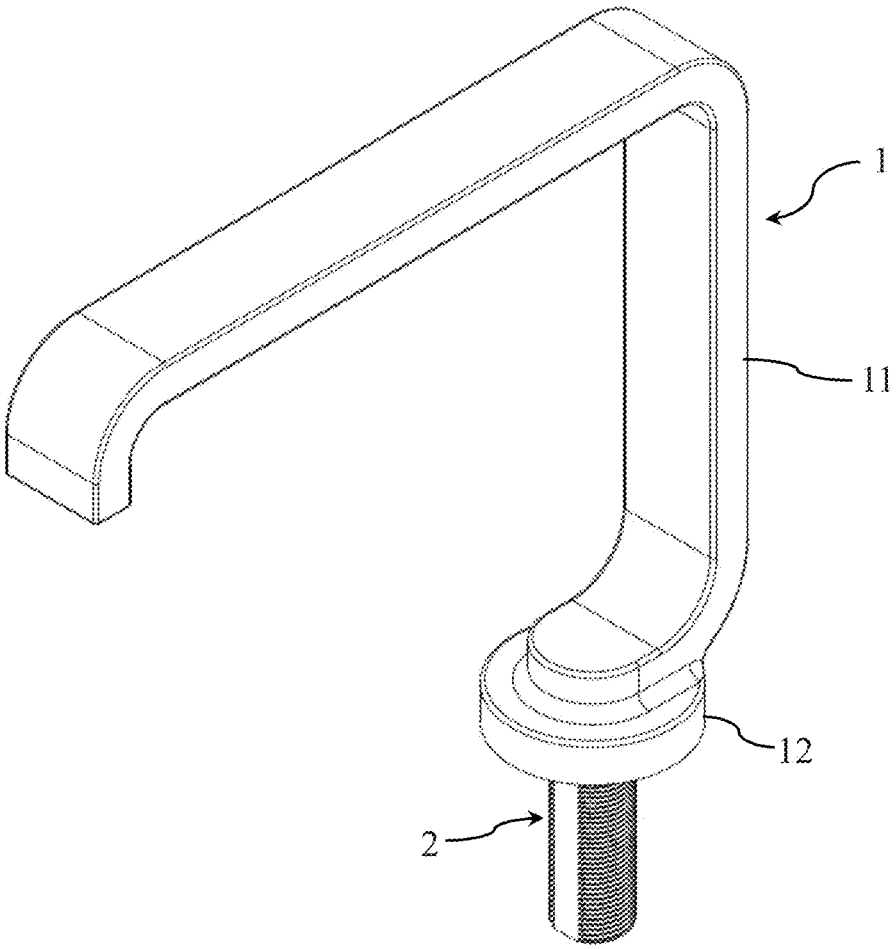
FIG. 1 is a perspective 1 view of a water nozzle installation structure, according to an exemplary embodiment.
Figure 2:
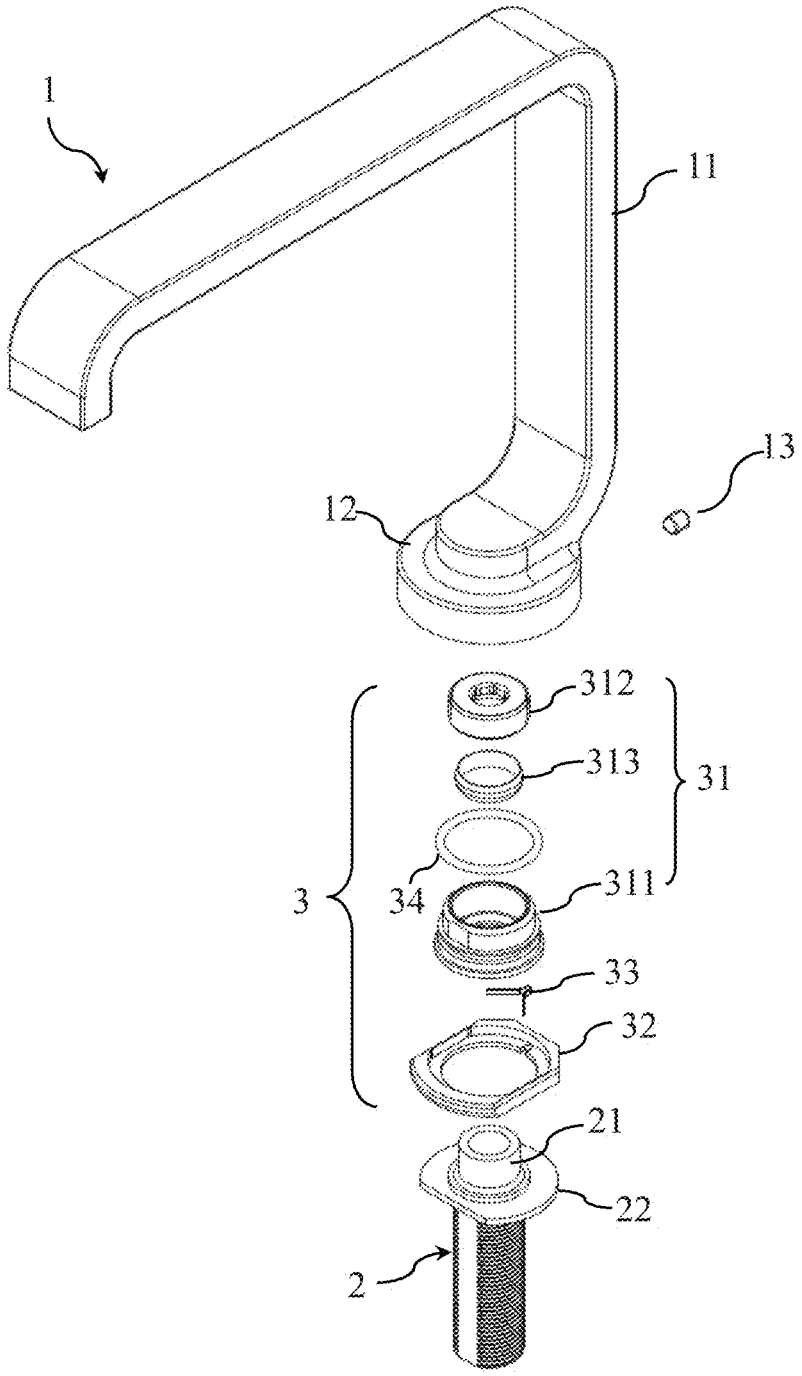
FIG. 2 is an exploded view of the water nozzle installation structure of FIG. 1, according to an exemplary embodiment.

The specific embodiments of the application will be further described with reference to the drawings hereinafter. Same parts are denoted by same reference numerals. It should be noted that the terms "front", "back", "left", "right", "up" and "down" used in the following description refer to the directions in the drawings, and the terms "inner" and "outer" refer to the directions towards or far away from geometric centers of specific parts respectively.

As shown in FIGS. 1-7, a water nozzle installation structure according to an embodiment of the application includes a water nozzle 1, a water inlet pipe 2 and a connection mechanism 3. The water nozzle installation structure is adaptable to various types of water inlet pipes 2 and has ease in assembly and disassembly.

Figure 10:
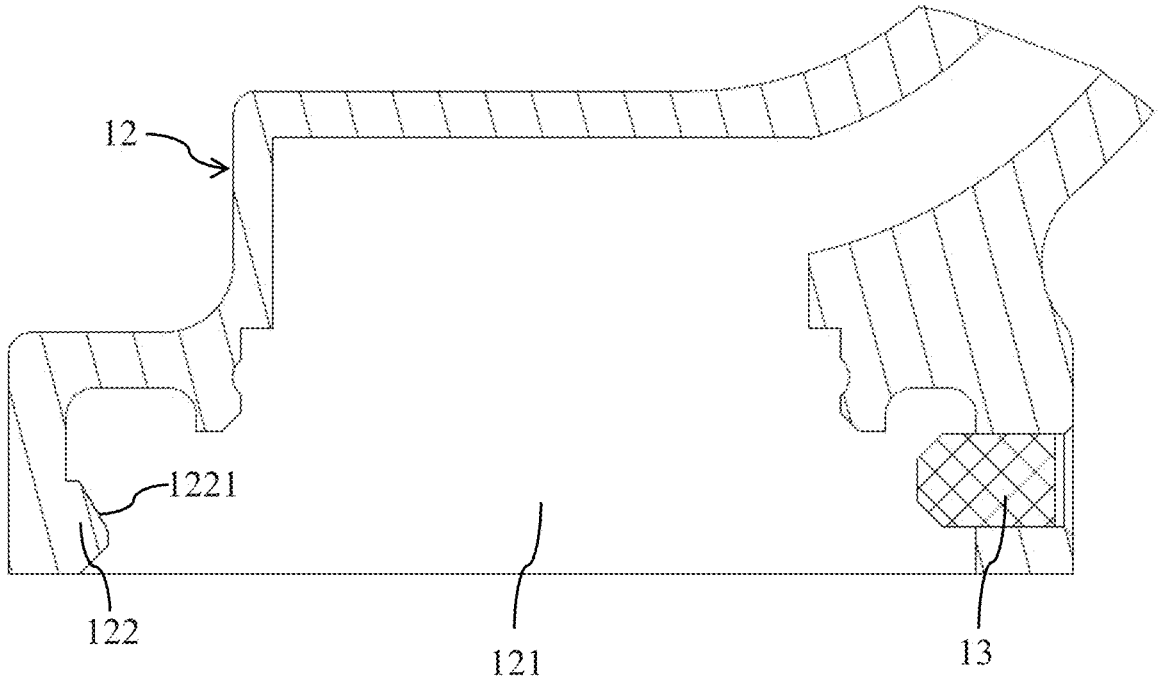
FIG. 10 is a sectional view of a water nozzle base.
Figure 11:
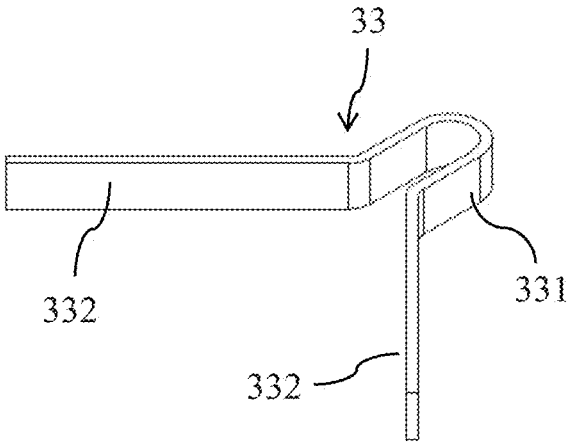
FIG. 11 is a perspective view of a resilient element.
Figure 12:
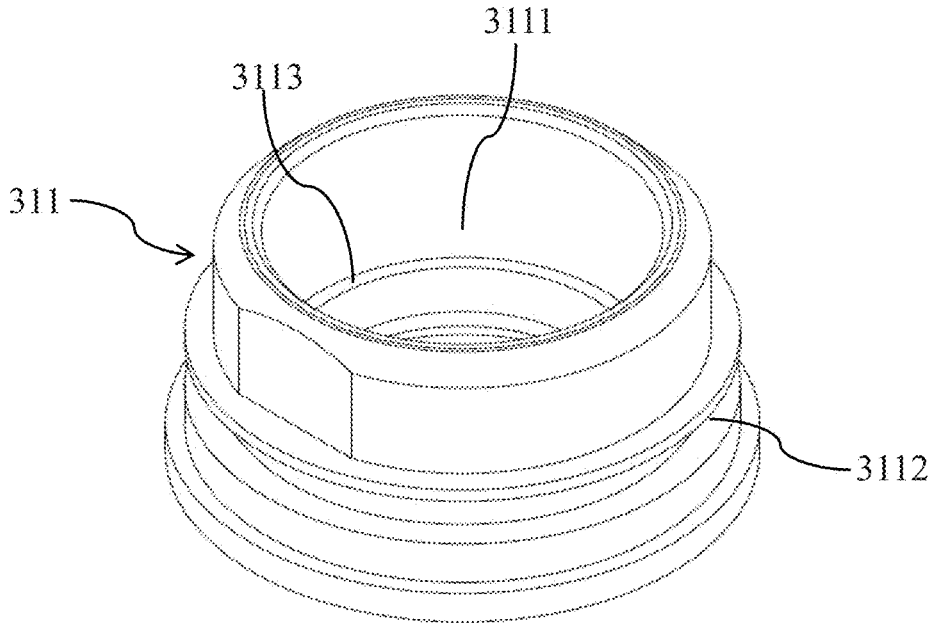
FIG. 12 is a perspective view of a sleeve member.
Figure 13:
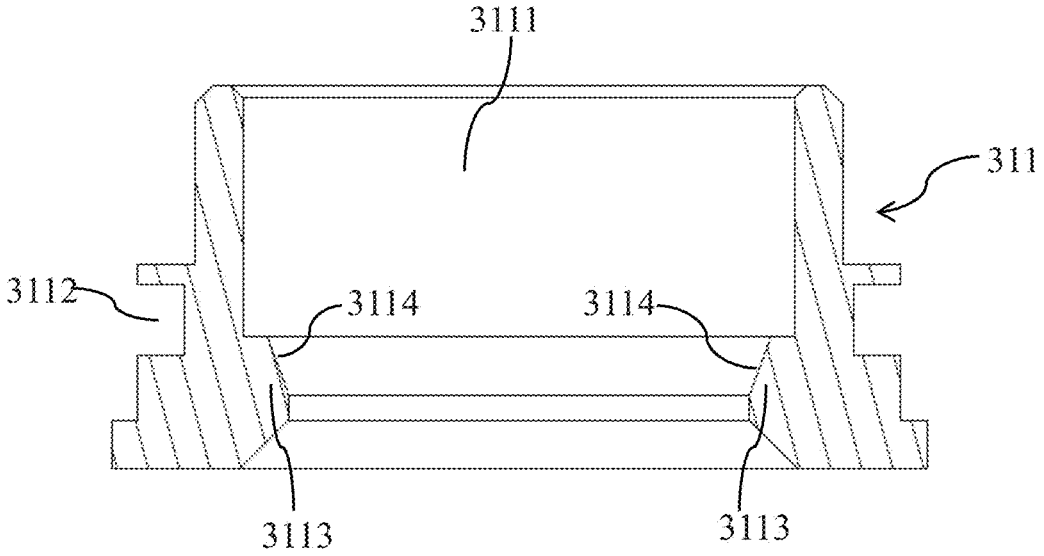
FIG. 13 is a sectional view of the sleeve member along the axial direction.

The water nozzle 1 may be a faucet. The water nozzle 1 includes a water nozzle body 11 and a water nozzle base 12. The water nozzle body 11 has a watercourse. The water nozzle base 12 is connected to a lower end of the water nozzle body 11. As shown in FIG. 10, the water nozzle base 12 has a mounting cavity 121, a pressing member 13, and a cavity wall protrusion 122. The pressing member 13 is positioned on one side of the water nozzle base 12. The pressing member 13 may be a set screw or a set pin. The pressing member 13 is removably connected to one side of a cavity wall of the mounting cavity 121. The one side of the cavity wall of the mounting cavity 121 has a cavity wall through hole, and the pressing member 13 is removably mounted in the cavity wall through hole. The cavity wall protrusion 122 protrudes inwardly towards the mounting cavity 121 and is positioned on a side opposite of the one side of a cavity wall of the mounting cavity 121 that the pressing member 13 is connected to.

The water inlet pipe 2 includes an outlet end 21. The outlet end 21 is positioned on an upper end of the water inlet pipe 2, with the upper end being an end closest to the connection mechanism 3 when the water nozzle installation structure is connected. The outlet end 21 may be a smooth or rough pipe.

The connection mechanism 3 is used to assemble the outlet end 21 of the water inlet pipe 2 with the water nozzle 1. The connection mechanism 3 is removably assembled in the mounting cavity 121. The connection mechanism 3 includes a fastening element 31. The fastening element 31 is assembled in the mounting cavity 121 and is sealed with the cavity wall of the mounting cavity 121, either by a self-sealing of the surfaces of the two, or by a seal ring 34.

Figure 3:
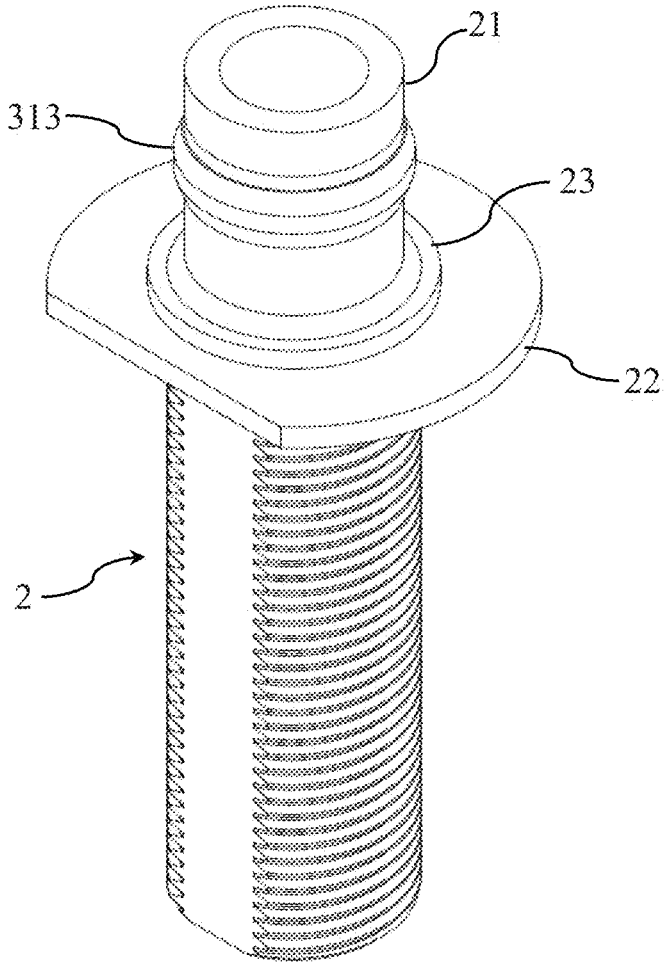
FIG. 3 is a perspective view of a clamp located on an outlet end of a water inlet pipe.
Figure 4:
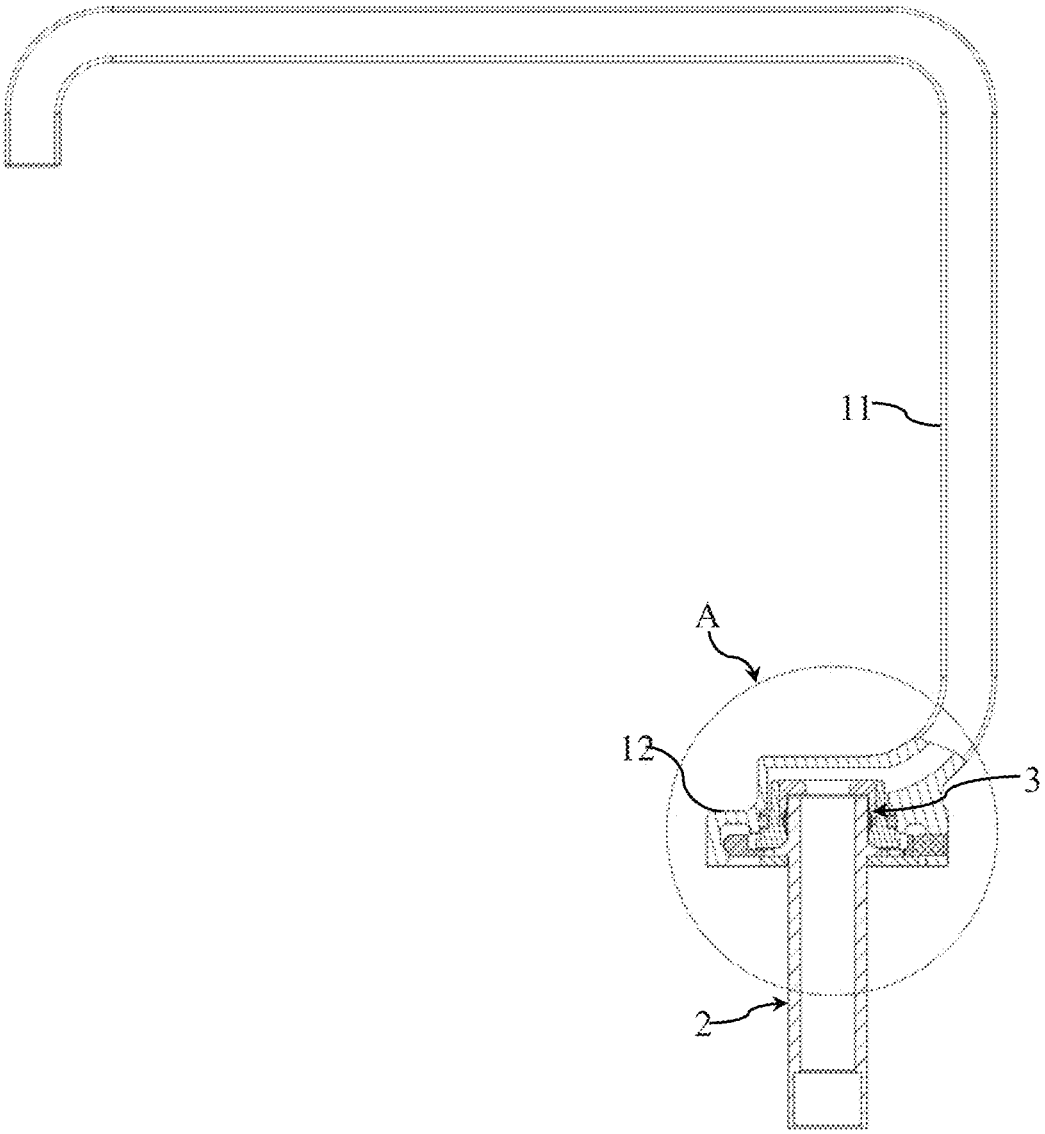
FIG. 4 is a sectional view of the water nozzle installation structure of FIG. 1, according to an exemplary embodiment.

The fastening element 31 includes a clamp 313. The clamp 313 is configured to secure the outlet end 21 of the water inlet pipe 2 into the fastening element 31. For example, as is shown in FIG. 3, the clamp 313 can sleeve onto the outlet end 21 to secure the water inlet pipe 2. In various embodiments, the fastening element 31 has a through hole extending vertically into which the outlet end 21 is inserted in, and the water flowing out from the outlet end 21 may enter an upper portion of the mounting cavity 121 and then flow out of the watercourse of the water nozzle body 11.

The connection mechanism 3 also includes a slide plate 32 and a resilient element 33. The slide plate 32 is connected (e.g., slidingly connected) with the fastening element 31 and configured to be tightly pressed against by the pressing member 13 and the resilient element 33 for driving the slide plate 32 to reset. When the pressing member 13 is in a pressing state, the slide plate 32 is coupled to the cavity wall protrusion 122 and is in a locking state, and the connection mechanism 3 is fastened in the mounting cavity 121. In various embodiments, an outer thread is positioned on the outer circumference surface of the pressing member 13, and the cavity wall through hole is an internal threaded hole. In such embodiments, the pressing member 13 is threadedly connected with the cavity wall through hole, and the pressing member 13 may be rotated so that an end portion of the pressing member 13 extends into the mounting cavity 121 to tightly press against the slide plate 32 of the connection mechanism 3. In various embodiments, the pressing member 13 may be rotated such that an end portion of the pressing member 13 exits the mounting cavity 121 to loosen the slide plate 32 or no longer tightly press against the slide plate 32. In various embodiments, the cavity wall protrusion 122 is configured to be clamped or tightly pressed against by one end of the slide plate 32 that is tightly pressed against by the pressing member 13, thereby locking the connection mechanism 3.

The slide plate 32 is used to support the fastening element 31 and to tightly press against the cavity wall protrusion 122, thereby achieving securing or locking of the connection mechanism 3. One end of the slide plate 32 faces the pressing member 13 and may be configured by the pressing member 13 to slide towards the side of the cavity wall protrusion 122 to tightly press against the cavity wall protrusion 122. In various embodiments, the slide plate 32 is clamped between the pressing member 13 and the cavity wall protrusion 122, and the slide plate 32 supports the fastening element 31 so as to secure the connection mechanism 3 in the mounting cavity 121.

The slide plate 32 and the fastening element 31 may have several connection ways, as long as they can slide relative to each other and the slide plate 32 does not block the through hole of the fastening element 31. In various embodiments, the slide plate 32 is sleeved onto the fastening element 31 using a through hole of the slide plate 32 that has a diameter larger than a diameter of the fastening element 31. In such embodiments, the slide plate 32 and the fastening element 31 slide relative to each other. The slide plate 32 may also be slidably connected to a side portion of the fastening element 31 or slidably connected to a bottom surface of the fastening element 31 and exposes the through hole of the fastening element 31.

The resilient element 33 may be a spring or a resilient sheet. The resilient element 33 is configured to drive the slide plate 32 to move towards the side of the pressing member 13 to reset from the time the pressing member 13 is loosened. When the pressing member 13 is loosened, the resilient element 33 drives the slide plate 32 to move towards the side of the pressing member 13 to allow an end portion of the slide plate 32 to leave the cavity wall protrusion 122. When this occurs, the connection mechanism 3 and the water inlet pipe 2 can be removed from the mounting cavity 121 of the water nozzle base 12. In various embodiments, the resilient element 33 is assembled between the slide plate 32 and the water inlet pipe 2. The resilient element 33 may be positioned in other positions as long as its configuration remains.

When assembling, the outlet end 21 of the water inlet pipe 2 is first assembled in the fastening element 31 and secured by the clamp 313. Then, either the water nozzle base 12 is placed onto the connection mechanism 3, or the connection mechanism 3 with the water inlet pipe 2 installed is placed into the mounting cavity 121. The pressing member 13 is tightened so that the slide plate 32 tightly presses against the cavity wall protrusion 122 to complete the installation.

When disassembly is required, the pressing member 13 is loosened such that the slide plate 32 leaves the cavity wall protrusion 122 under the action of the resilient element 33. Then, the water inlet pipe 2 and the connection mechanism 3 can be disassembled from the mounting cavity 121 together, making disassembly and assembly convenient. This process can be applied to different kinds of water inlet pipes 2. Even if the outlet end 21 has a pipe wall that is a smooth surface, the connection mechanism 3 can be applied, allowing for a high degree of practicality.

In various embodiments, as shown in FIGS. 2, 5 and 12-17, the fastening element 31 includes a sleeve member 311 and a locking member 312. The slide plate 32 is slidingly connected to the sleeve member 311. The sleeve member 311 includes a sleeve wall bulge ring 3113 for stopping the clamp 313. The sleeve wall bulge ring 3113 is positioned on an inner surface of a sleeve wall of the sleeve member 311. At least a portion of the outlet end 21 extends into the sleeve member 311, and the clamp 313 sleeves over the outlet end 21 and is located above the sleeve wall bulge ring 3113. The sleeve wall bulge ring 3113 is approximately located on a lower half portion of the sleeve member 311 and is used to stop the clamp 313 from below. The locking member 312 is connected to the sleeve member 311 and presses the clamp 313.

The sleeve member 311 may be substantially in the shape of a cylinder and has a central hole 3111. The sleeve member 311 includes a positioning groove 3112 for assembling the seal ring 34. The positioning groove 3112 is positioned on an outer circumferential surface of the sleeve member 311. The slide plate 32 is slidingly connected with the sleeve member 311, and the two are connected in a manner similar to the aforementioned connection way between the slide plate 32 and the fastening element 31, which will not be repeated herein.

The locking member 312 may be a pressing plate, a pressing block, a press sleeve, a nut and the like. The locking member 312 has a through hole in communication with the central hole 3111 for water passage. The locking member 312 may be threadedly connected with the sleeve member 311 or may be connected by pins, buckles or the like.

In these embodiments, when assembling, the outlet end 21 of the water inlet pipe 2 extends into the sleeve member 311 from bottom to top. The clamp 313 is fitted onto the outlet end 21 from top to bottom. The clamp 313 falls onto the sleeve wall bulge ring 3113, and then the locking member 312 is connected to the sleeve member 311 from top to bottom and presses the clamp 313 and secures the clamp 313, thereby securing the water inlet pipe 2.

The clamp 313 and the outlet end 21 have two fit manners. One manner is that the clamp 313 is in direct interference fit with the outlet end 21. In such manner, the clamp 313 maintains a tight fit around the outlet end 21. The other manner is that the clamp 313 is in clearance fit with the outlet end 21. Finally, the clamp 313 is squeezed by the locking member 312 and the sleeve wall bulge ring 3113, such that the clamp 313 is deformed to fasten the outlet end 21.

In various embodiments, as shown in FIGS. 13, and 15-17, an outer circumferential surface of the clamp 313 has an upper tapered surface 3131 and a lower tapered surface 3132. The radius of the lower tapered surface 3132 gradually increases and the radius of the upper tapered surface 3131 gradually decreases along a direction from bottom to top. In other words, the outer circumference surface of the clamp 313 is roughly thick in the middle and tapered at the upper and lower ends, comprising the upper tapered surface 3131 and the lower tapered surface 3132. The upper tapered surface 3131 is located in the middle and upper portion of the outer circumference surface of the clamp 313 and the lower tapered surface 3132 is located in the middle and lower portion of the outer circumference surface of the clamp 313. A lower edge of the upper tapered surface 3131 is directly connected with an upper edge of the lower tapered surface 3132 or the lower edge and the upper edger are separated by an intermediate circular surface.

The sleeve wall bulge ring 3113 has a bulge ring tapered surface 3114 that is located on an upper end or top surface of the sleeve wall bulge ring 3113. The bulge ring tapered surface 3114 is adapted to the lower tapered surface 3132. In other words, the bulge ring tapered surface 3114 gradually becomes thinner from the top to the bottom, which is adapted with the lower tapered surface 3132 so as to be able to fit with the lower tapered surface 3132. The lower tapered surface 3132 tightly presses against the bulge ring tapered surface 3114.

The locking member 312 has a locking member tapered surface 3124 that is located on a lower end or bottom surface of the locking member 312. The locking member tapered surface 3124 is adapted to the upper tapered surface 3131. In other words, the locking member tapered surface 3124 gradually becomes thicker from top to bottom, which is adapted with the upper tapered surface 3131 so as to be able to fit with the upper tapered surface 3131. The locking member tapered surface 3124 tightly presses against the upper tapered surface 3131.

The clamp 313 is clamped between the bulge ring tapered surface 3114 and the locking member tapered surface 3124, and the cooperating tapered surfaces fit each other. This configuration allows for a large contact area, resulting in a better clamping effect.

In this embodiment, the clamp 313 may be assembled with the outlet end 21 in a clearance fit manner. In this manner, the clamp 313 is squeezed and deformed by the bulge ring tapered surface 3114 and the locking member tapered surface 3124, thereby clamping the outlet end 21 and securing the water inlet pipe 2. Compared with the manner in which the clamp 313 is fit with the outlet end 21 by direct interference fit, this manner is convenient for adjusting the position of the outlet end 21 in the sleeve member 311 and will not cause any impact damage to the pipe wall of the outlet end 21.

Figure 14:
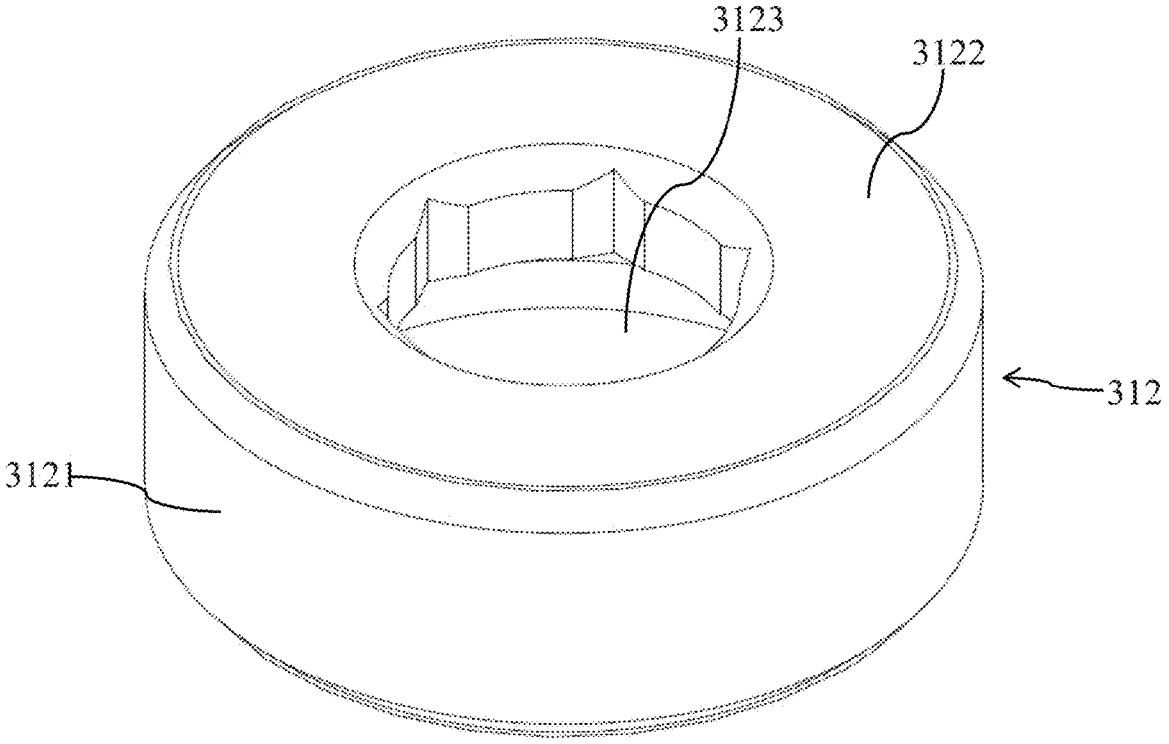
FIG. 14 is a perspective view of a locking member.
Figure 15:
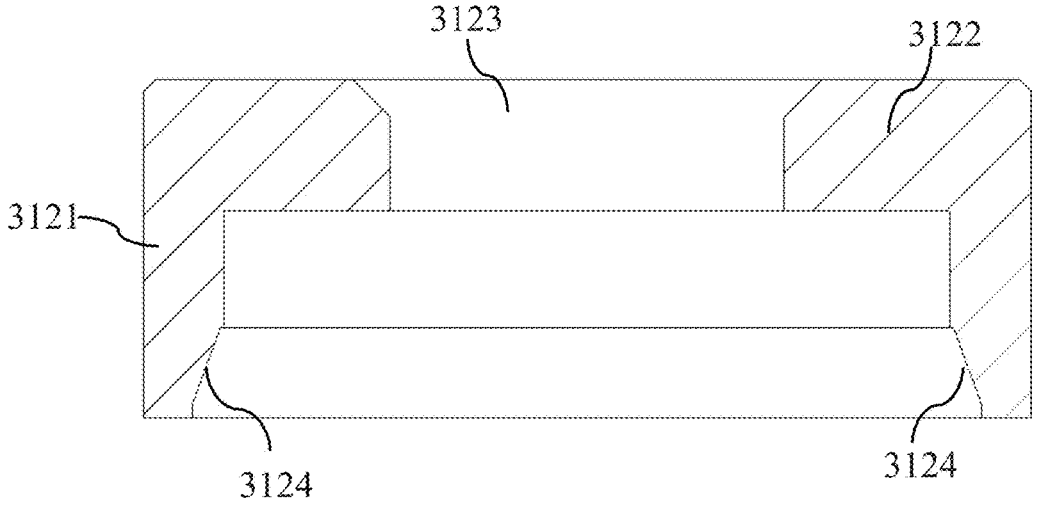
FIG. 15 is a sectional view of the locking member along the axial direction.
Figure 16:
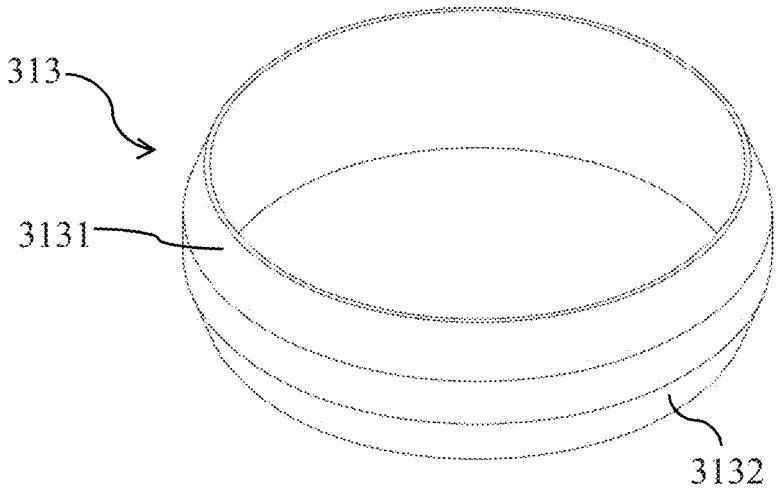
FIG. 16 is a perspective view of a clamp.
Figure 17:
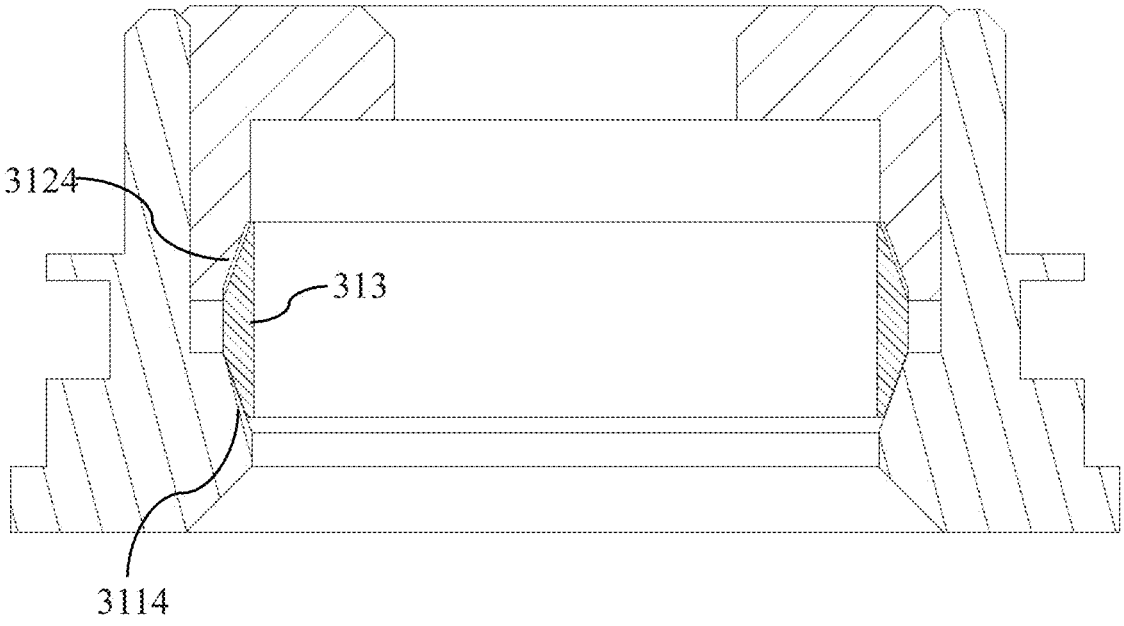
FIG. 17 is a sectional view of a fastening element along the axial direction.

In various embodiments, as shown in FIGS. 14 and 17, the locking member 312 is threadedly connected with the sleeve member 311. The locking member 312 has a locking member through hole 3123 or a locking member recess that can cooperate with a wrench or other tool. The locking member through hole 3123 is positioned on a top surface of the locking member 312. In such embodiments, an outer circumference surface of the locking member 312 has an external thread and a hole wall of the central hole 3111 has internal thread. The locking member 312 is threadedly connected with the hole wall of the central hole 3111, and the user can rotate the locking member 312 through a wrench or other tool to adjust the position of the locking member 312 to make the locking member 312 tightly press against the clamp 313 underneath. This configuration facilitates the disassembly and assembly.

In order to facilitate the user to rotate the locking member 312, the locking member through hole 3123 or locking member recess can cooperate or interlock with a wrench tool to facilitate the user to rotate the locking member 312. The shape of the locking member through hole 3123 or locking member recess is a non-circular, which may be a polygonal structure such as a triangle, a quadrilateral, or a waist-shaped structure.

In various embodiments, as shown in FIGS. 14, and 15-17, the locking member 312 includes a locking member sleeve body 3121 and a locking member top cap 3122. The locking member top cap 3122 is connected to an upper end of the locking member sleeve body 3121. The locking member sleeve body 3121 is connected to the sleeve member 311 and presses the clamp 313. In various embodiments, the locking member sleeve body 3121 and the locking member top cap 3122 are formed integrally.

When assembling, the locking member sleeve body 3121 is connected to the central hole 3111 of the sleeve member 311, the locking member sleeve body 3121 may be in interference fit with the central hole 3111 or threadedly connected to the hole wall of the central hole 3111. The outlet end 21 extends into the locking member sleeve body 3121 and is stopped and limited by the locking member top cap 3122. The lower end of the locking member sleeve body 3121 tightly presses against the clamp 313, thereby clamping the clamp 313 between the sleeve wall bulge ring 3113 and the lower end of the locking member sleeve body 3121. With this arrangement, the outlet end 21 can be inserted upwards to a deeper depth or by a longer length, and the clamp 313 can be connected to a position slightly lower than the outlet end 21, which can better prevent the clamp 313 from being detached from the upper end of the outlet end 21.

Preferably, the outer circumference of the locking member sleeve body 3121 has an external thread, the hole wall of the central hole 3111 has an internal thread, and the locking member sleeve body 3121 and the central hole 3111 are threadedly connected. In various embodiments, the locking member through hole 3123 or locking member recess is located substantially in the middle portion of the locking member top cap 3122. Preferably, the locking member tapered surface 3124 is located on the internal side of the lower end of the locking member sleeve body 3121.

Figure 5:
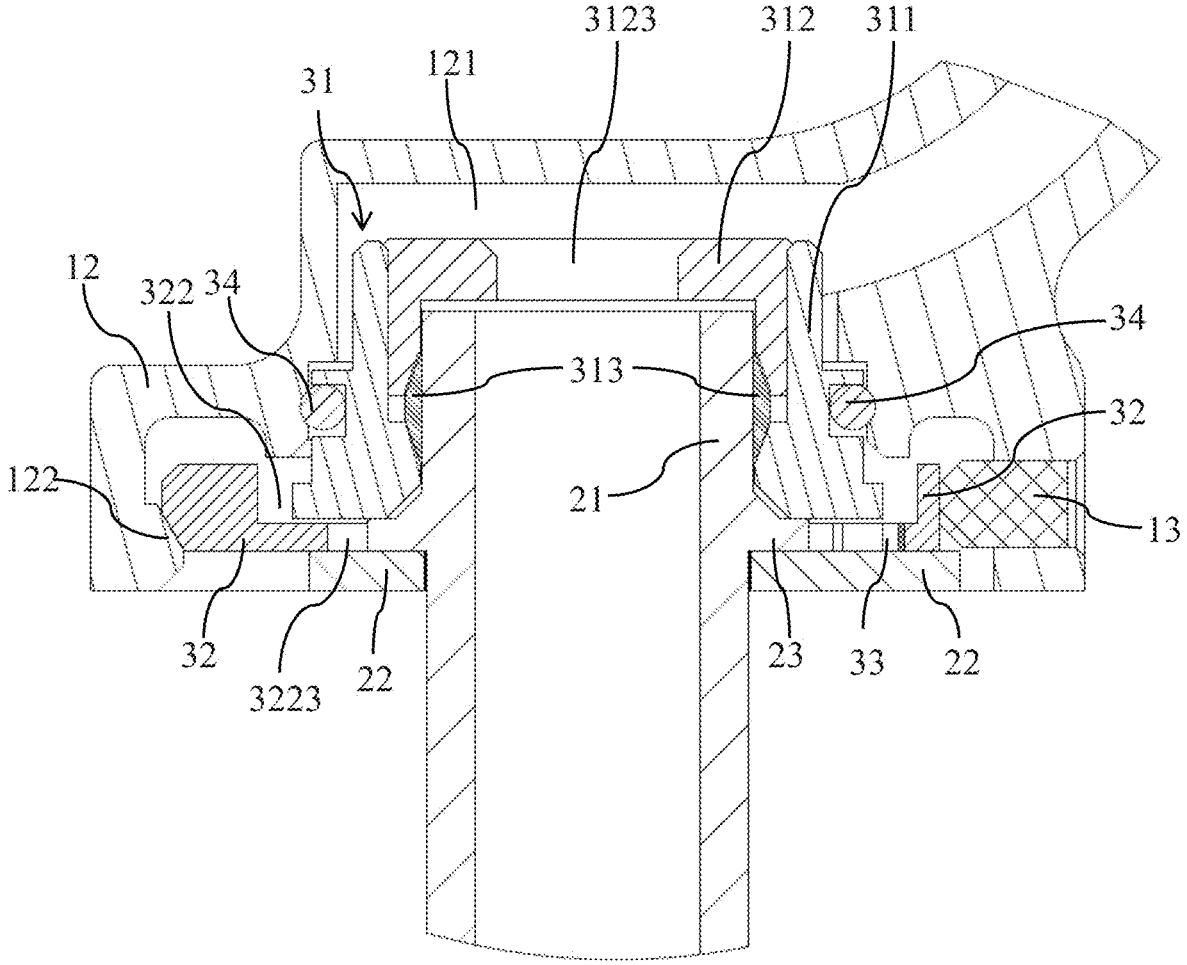
FIG. 5 is an enlarged schematic view of part A of FIG. 4.
Figure 6:
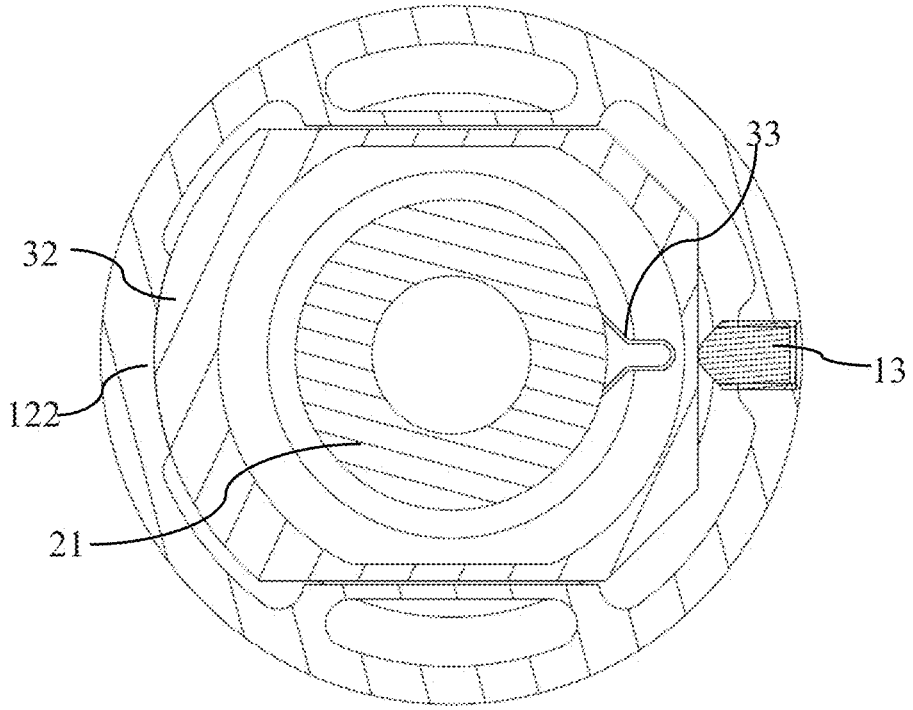
FIG. 6 is a sectional view of the water inlet installation structure along an axial direction of a pressing member when the pressing member is in a pressing state, wherein the sectional plane is perpendicular to the axial direction of the water inlet pipe.
Figure 7:
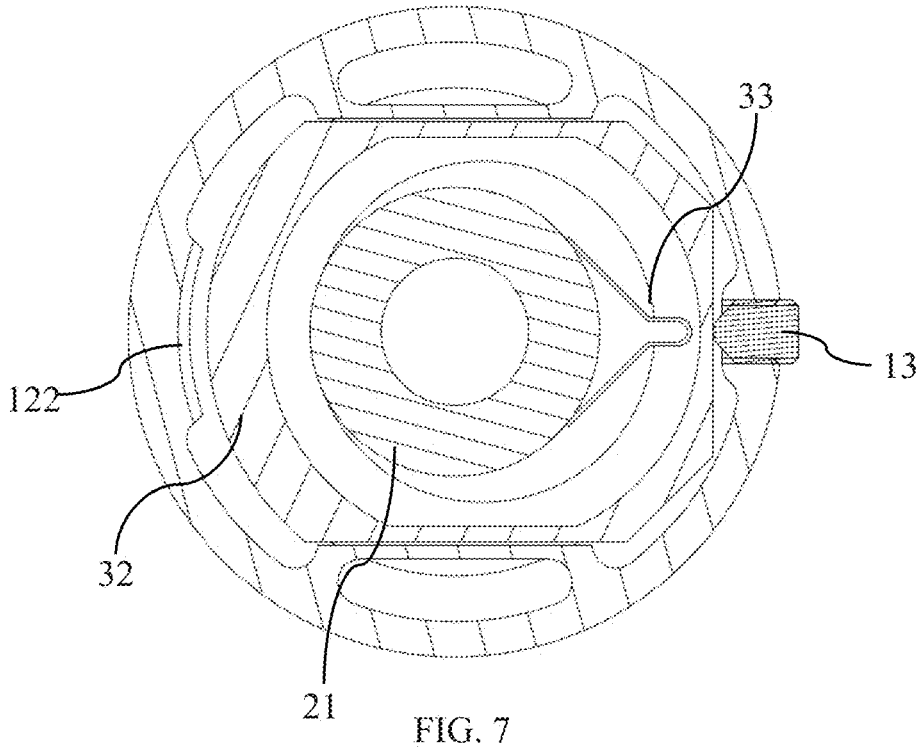
FIG. 7 is a sectional view of the water inlet installation structure along an axial direction of a pressing member when the pressing member is in a loosened state, wherein the sectional plane is perpendicular to the axial direction of the water inlet pipe.
Figure 9:
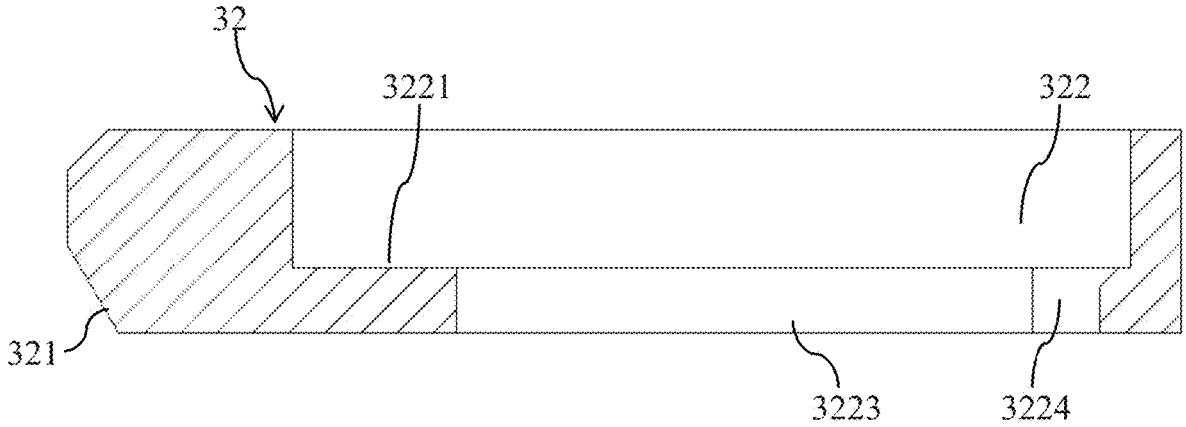
FIG. 9 is a sectional view of the slide plate of FIG. 8 along a bottom plate notch.

In various embodiments, as shown in FIGS. 5, 9, and 10, the cavity wall protrusion 122 has a protrusion ramp 1221. The protrusion ramp 1221 gradually extends obliquely upwardly along the direction from the slide plate 32 to the cavity wall protrusion 122. The slide plate 32 includes a slide plate ramp 321 that is adapted to the protrusion ramp 1221 on a side of the slide plate 32 facing the cavity wall protrusion 122. In other words, the slide plate ramp 321 and the protrusion ramp 1221 are substantially parallel. The slide plate ramp 321 is tightly pressed against the protrusion ramp 1221 when the pressing member 13 is in a pressing state (e.g., the pressing member 13 is tightly pressing against the slide plate 32). This can lock the slide plate 32, and also prevent the slide plate 32 from falling, which is beneficial for enhancing the fastening of the slide plate 32 and the cavity wall protrusion 122.

Figure 8:
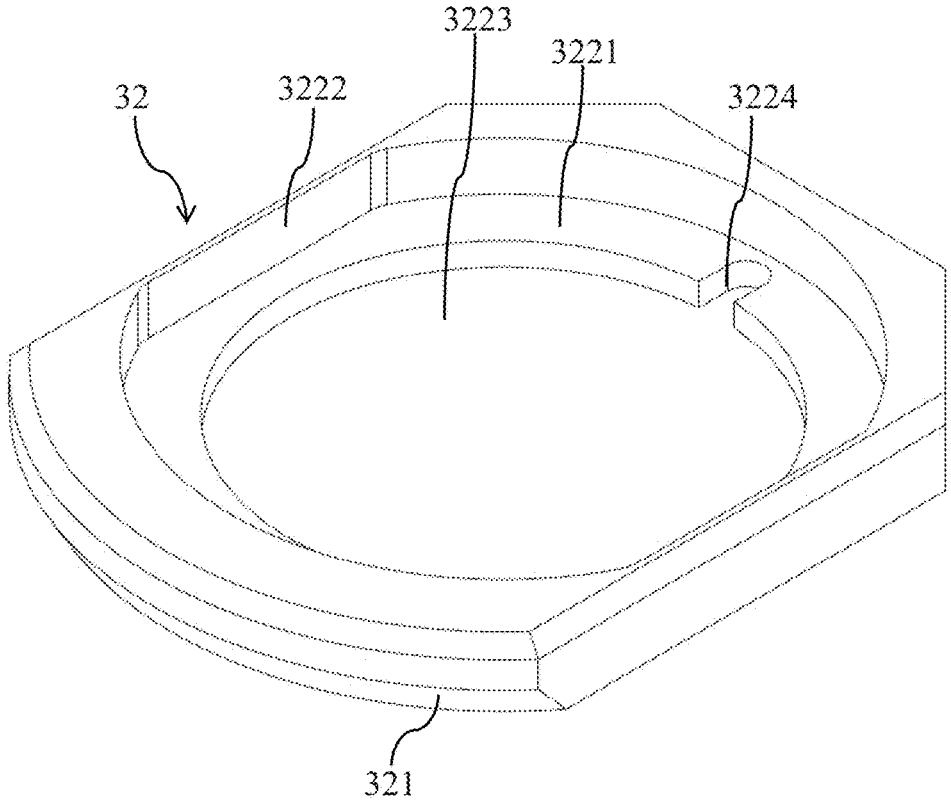
FIG. 8 is a perspective view of a slide plate.

In various embodiments, as shown in FIGS. 5, 8, and 9, a top surface of the slide plate 32 has an assembly groove 322. The assembly groove 322 has an assembly groove bottom plate 3221 that includes a bottom plate through hole 3223. The water inlet pipe 2 includes a platform 22. The water inlet pipe 2 passes through the bottom plate through hole 3223. A lower end of the fastening element 31 is in clearance fit with the assembly groove 322 and the slide plate 32 is on the platform 22. In such embodiments, the slide plate 32 supports the fastening element 31 and is capable of sliding relative to the fastening element 31.

The platform 22 is substantially located at the bottom portion of the outlet end 21 and configured to support the slide plate 32. The slide plate 32 falls onto the platform 22 and the slide plate 32 is capable of sliding on the platform 22. The top surface of the slide plate 32 has the assembly groove 322 for placing the fastening element 31, specifically placing the lower end of the sleeve member 311. The dimensions of the assembly groove 322 are larger than the dimensions of the fastening element 31 (the sleeve member 311) along the direction from the pressing member 13 to the cavity wall protrusion 122. The dimensions of the assembly groove 322 are much larger than the dimensions of the fastening element 31 (the diameter of the sleeve member 311), so that the slide plate 32 is slidable in this direction relative to the fastening element 31. The assembly groove bottom plate 3221 of the assembly groove 322 includes the bottom plate through hole 3223 for the water inlet pipe 2 to pass through in order to enter the fastening element 31.

When assembling, the water inlet pipe 2 passes through the bottom plate through hole 3223. The outlet end 21 of the water inlet pipe 2 is secured in the fastening element 31 through the clamp 313 and the bottom portion of the fastening element 31 (the sleeve member 311) is in clearance fit with the assembly groove 322. The slide plate 32 is located on the platform 22, the platform 22 supports the slide plate 32, and the slide plate 32 supports the fastening element 31 (the sleeve member 311). When the slide plate 32 is clamped between the pressing member 13 and the cavity wall protrusion 122, the entire connection mechanism 3 and the water inlet pipe 2 are fixed. After loosening the slide plate 32 from the pressing member 13, the entire connection mechanism 3 and the water inlet pipe 2 can be removed from the mounting cavity 121.

In various embodiments, as shown in FIGS. 5, 8, and 9, the assembly groove 322 has a waist or an elongated shape. The assembly groove 322 extends along the direction from the pressing member 13 to the cavity wall protrusion 122, and the fastening element 31 is in slidable connection with the groove walls 3222 on both sides of the assembly groove 322. In such embodiments, the assembly groove 322 substantially has an elongated (rectangular) or waist shape in a top view perspective. The two ends of the waist-shaped structure are semicircular, and a middle of the waist-shaped structure has the same width (rectangular). A length direction of the assembly groove 322 is consistent with a direction from the pressing member 13 to the cavity wall protrusion 122.

The dimension of the fastening element 31 along a width direction of the assembly groove 322 (a diameter of the sleeve member 311) is slightly smaller than the width dimension of the assembly groove 322. Therefore, the two side surfaces (which may be referred to as a front side surface and a rear side surface) of the fastening element 31 (the sleeve member 311) are in slidable contact with the two sides of the groove walls 3222 (which may be referred to as a front side groove wall and a rear side groove wall) along the width direction of the assembly groove 322. The assembly groove 322 serves as a guide, so that when the slide plate 32 is sliding relative to the fastening element 31 (the sleeve member 311), the slide plate 32 is restricted to slide along the length direction since the front side surface and the rear side surface of the fastening element 31 (the sleeve member 311) are in contact with the front side groove wall and rear side groove wall of the assembly groove 322.

In various embodiments, as shown in FIGS. 5-8 and 11, the assembly groove bottom plate 3221 includes a bottom plate notch 3224 that is in communication with the bottom plate through hole 3223. In various embodiments, the bottom plate notch 3224 is positioned on the hole wall of the bottom plate through hole 3223, and the opening of the bottom plate notch 3224 is in communication with the bottom plate through hole 3223. The bottom plate notch 3224 is located between the bottom plate through hole 3223 and the pressing member 13. A fixed end of the resilient element 33 is assembled in the bottom plate notch 3224 and the resilient element 33 abuts against the water inlet pipe 2 to form a secure connection. When the pressing member 13 tightly presses against the slide plate 32 to move the slide plate 32 towards the side of the cavity wall protrusion 122, the resilient element 33 is squeezed and deformed and accumulates energy. After loosening the pressing member 13, the resilient element 33 resets, driving the slide plate 32 towards the side of the pressing member 13 to reset.

Preferably, in various embodiment, the resilient element 33 uses a resilient sheet structure. The resilient sheet structure includes a U-shaped section 331 and two resilient sheets 332, the two resilient sheets 332 are connected to both the ends of the U-shaped section 331 and are in an expanded shape. In other words, the distance between the two resilient sheets 332 is gradually increased in the direction along a central axis from the U-shaped section 331 to the water inlet pipe 2 in order to abut against the fastening element 31 or the water inlet pipe 2.

In an initial state, the width of the U-shaped section 331 is slightly wider than the width of the bottom plate notch 3224. When assembling, the U-shaped section 331 is squeezed into the bottom plate notch 3224, thus fixing the resilient element 33. The two resilient sheets 332 may simultaneously abut against the water inlet pipe 2. When the pressing member 13 tightly presses against the slide plate 32 to move the slide plate 32 towards the side of the cavity wall protrusion 122, the two resilient sheets 332 are squeezed and deformed to expand and accumulate energy. After loosening the pressing member 13, the two resilient sheets 332 reset, driving the slide plate 32 towards the side of the pressing member 13 to reset.

In various embodiments, as shown in FIGS. 3 and 5-7, the platform 22 includes a retaining ring 23 that is positioned on an upper surface of the platform 22. The retaining ring 23 is located in the bottom plate through hole 3223. The resilient element 33 abuts against the retaining ring 23 to form a secure connection. In various embodiments, the two resilient sheets 332 abuts against the retaining ring 23. In these embodiments, the retaining ring 23 is connected to the water inlet pipe 2. The retaining ring 23 and the platform 22 can be formed integrally. When assembling, the retaining ring 23 is fitted in the bottom plate through hole 3223. This configuration prevents the slide plate 32 from directly colliding with the water inlet pipe 2 when sliding and serves a protective function. The retaining ring 23 is roughly level with the bottom plate notch 3224, and the two resilient sheets 332 respectively abut against the retaining ring 23. This configuration prevents the two resilient sheets 332 from directly acting on the pipe wall of the water inlet pipe 2, and further serves as a protective function.

The above technical solutions may be combined as required to achieve the best technical effect. The above are merely the principle and the preferred embodiments of the application. It should be pointed out that, for those of ordinary skills in the art, several other modifications may be made on the basis of the principle of the application, which should also be regarded as falling in the protection scope of the application.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References to "or" may be construed as inclusive so that any terms described using "or" may indicate any of a single, more than one, and all of the described terms. References to at least one of a conjunctive list of terms may be construed as an inclusive OR to indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the assembly as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A water nozzle installation structure, comprising:

a water nozzle comprising:

a water nozzle base having a mounting cavity, a pressing member, and a cavity wall protrusion, the pressing member removably coupled to a first side of a cavity wall of the mounting cavity, the cavity wall protrusion positioned on a side opposite of the first side;

a connection mechanism comprising:

a fastening element having a clamp, a slide plate slidingly connected with the fastening element and configured to be pressed against the pressing member, and a resilient element configured to drive the slide plate to a rest state, the connection mechanism removably assembled in the mounting cavity; and a water inlet pipe comprising an outlet end that is secured in the fastening element by the clamp, wherein the slide plate is coupled with the cavity wall protrusion and in a locking state and the connection mechanism is fastened in the mounting cavity when the pressing member is in a pressing state.

2. The water nozzle installation structure of claim 1, the fastening element further comprising:

a sleeve member, the slide plate slidingly connected with the sleeve member, the sleeve member comprising a sleeve wall bulge ring configured to stop the clamp, the outlet end extending into the sleeve member such that the clamp sleeves over the outlet end and is located above the sleeve wall bulge ring; and a locking member coupled to the sleeve member and configured to press the clamp.

3. The water nozzle installation structure of claim 2, wherein:

the clamp comprises an upper tapered surface and a lower tapered surface, a first radius of the lower tapered surface gradually increasing and a second radius of the upper tapered surface gradually decreasing along a direction from bottom to top, the direction being from the water inlet pipe to the connection mechanism;

the sleeve wall bulge ring comprises a bulge ring tapered surface adapted to the lower tapered surface, the lower tapered surface tightly presses against the bulge ring tapered surface; and the locking member comprises a locking member tapered surface adapted to the upper tapered surface, the locking member tapered surface tightly presses against the upper tapered surface.

4. The water nozzle installation structure of claim 2, wherein the locking member is threadedly connected with the sleeve member, the locking member having a locking member through hole or a locking member recess for use with a wrench tool.

5. The water nozzle installation structure of claim 2, the locking member comprising:

a locking member sleeve body, the locking member sleeve body coupled to the sleeve member and tightly pressing against the clamp; and a locking member top cap coupled to an upper end of the locking member sleeve body.

6. The water nozzle installation structure of claim 1, wherein:

the cavity wall protrusion comprises a protrusion ramp that gradually extends obliquely upwardly along a direction from the slide plate to the cavity wall protrusion;

the slide plate comprises a slide plate ramp adapted to the protrusion ramp; and the slide plate ramp tightly presses against the protrusion ramp when the pressing member is in the pressing state.

7. The water nozzle installation structure of claim 1, wherein:

the slide plate comprises an assembly groove, the assembly groove positioned on a top surface of the slide plate, the assembly groove comprising an assembly groove bottom plate and a bottom plate through hole; and the water inlet pipe comprises a platform, the water inlet pipe passing through the bottom plate through hole, and a lower end of the fastening element is fitted in the assembly groove with the slide plate on the platform.

8. The water nozzle installation structure of claim 7, wherein the lower end of the fastening element is fitted in the assembly groove by clearance fit.

9. The water nozzle installation structure of claim 7, wherein the assembly groove has an elongated or waist shape, the assembly groove extending along a direction from the pressing member to the cavity wall protrusion, and the fastening element is in slidable contact with groove walls on both sides of the assembly groove.

10. The water nozzle installation structure of claim 7, wherein:

the assembly groove bottom plate comprises a bottom plate notch that is in communication with the bottom plate through hole, the bottom plate notch located between the bottom plate through hole and the pressing member; and a fixed end of the resilient element is assembled in the bottom plate notch such that the resilient element abuts against the water inlet pipe.

11. The water nozzle installation structure of claim 10, wherein an upper surface of the platform includes a retaining ring that is located in the bottom plate through hole such that the resilient element abuts against the retaining ring.

12. A method for water nozzle installation comprising:

fastening a water inlet pipe to a connection mechanism, an outlet end of the water inlet pipe assembled to a fastening element of the connection mechanism;

securing the outlet end to the fastening element via a clamp in the connection mechanism;

securing the fastened water inlet pipe and connection mechanism to a water nozzle via a structure in the water nozzle, the water nozzle comprising a pressing member; and tightening the pressing member such that a slide plate in the connection mechanism tightly presses against a cavity wall protrusion in the water nozzle.

13. The method of claim 12, wherein the structure in the water nozzle is a water nozzle base or a mounting wall cavity.

14. The method of claim 12 wherein the clamp secures to the outlet end via clearance fit or direct interference fit.

15. The method of claim 12 wherein the outlet end of the water inlet pipe is assembled to the connection mechanism via a sleeve member in the connection mechanism, the outlet end extending into the sleeve member and the clamp falling onto a sleeve wall bulge ring of the sleeve member to secure the outlet end and the water inlet pipe.

* * * * *